US006367715B1

(12) United States Patent
Rieth

(10) Patent No.: US 6,367,715 B1
(45) Date of Patent: Apr. 9, 2002

(54) METHOD AND DEVICE FOR PRODUCING AN AEROSOL

(76) Inventor: Stephan Rieth, Auf Merzborn 1, D-66646 Marpingen (DE)

( * ) Notice: Subject to any disclaimer, the term of this patent is extended or adjusted under 35 U.S.C. 154(b) by 0 days.

(21) Appl. No.: 09/462,034

(22) PCT Filed: Jul. 3, 1998

(86) PCT No.: PCT/EP98/04112

§ 371 Date: Dec. 29, 1999

§ 102(e) Date: Dec. 29, 1999

(87) PCT Pub. No.: WO99/01228

PCT Pub. Date: Jan. 14, 1999

(30) Foreign Application Priority Data

Jul. 4, 1997 (DE) ..... 197 28 622

(51) Int. Cl.[7] ..... B05B 1/28

(52) U.S. Cl. ..... 239/290; 239/291; 239/310; 239/311; 239/314; 239/333; 239/335; 239/462; 239/DIG. 23

(58) Field of Search ..... 239/8, 290, 291, 239/310, 311, 314, 335, 462, DIG. 23, 333

(56) References Cited

U.S. PATENT DOCUMENTS

| | | | | |
|---|---|---|---|---|
| 1,594,641 A | * | 8/1926 | Starr | 239/8 |
| 4,702,415 A | * | 10/1987 | Hughes | 239/8 |
| 4,964,568 A | * | 10/1990 | Rotolico et al. | 239/8 |
| 5,549,247 A | | 8/1996 | Rossman et al. | |
| 5,678,765 A | * | 10/1997 | Dobbs et al. | 239/333 |

FOREIGN PATENT DOCUMENTS

| | | |
|---|---|---|
| DE | 867830 | 2/1953 |
| EP | 0119527 | 9/1984 |
| EP | 0611933 | 8/1994 |
| FR | 1364785 | 5/1963 |
| FR | 2291800 | 11/1974 |
| GB | 409918 | 5/1934 |

OTHER PUBLICATIONS

Patent Abstracts of Japan, vol. 009, No. 002 (P–325), Jan. 8, 1985 & JP 59 153164 (Nippon Denshi KK), Sep. 1, 1984.
Patent Abstracts of Japan, vol. 016, No. 290, (M–1272), Jun. 26, 1992 & JP 04 076362 A (Shiyouwa Tansan KK), Mar. 11, 1992.

* cited by examiner

*Primary Examiner*—Robin O. Evans
(74) *Attorney, Agent, or Firm*—Friedrich Kueffner

(57) ABSTRACT

The device for forming an aerosol has a device for adjusting the amount of particle former transported by the spray jet per time unit and/or a device for adjusting the amount of compressed gas passing per time unit through the wall. Such a device can be used for fluid treatment of sensitive, easily deformable objects, especially for their cooling, or other applications requiring certain metering of the particle formation, for example, in a burner. By providing a permeable wall having pores, it is possible to produce fluid particles with minimal kinetic energy by the effect of the compressed gas flowing through the permeable wall so that at the exit side of the wall a fluid particle stream with particles having extremely low energy per particle can be produced.

16 Claims, 2 Drawing Sheets

METHOD AND DEVICE FOR PRODUCING AN AEROSOL

BACKGROUND OF THE INVENTION

1. Field of the Invention

The invention relates to a device for producing fluid particles, especially producing an aerosol, with a permeable wall having pore-like through channels, a nozzle for applying the spray jet onto the permeable wall, and a device for loading the permeable wall with a compressed gas penetrating the permeable wall while entraining the particle former under formation of the fluid particles.

2. Description of the Related Art

From U.S. Pat. No. 5,549,247, such a device for spraying fragrances is known. In this device the permeable wall is formed by a stopper of wire mesh which is arranged above the stopper in a cylindrical chamber with a mist exit opening. Below the stopper a nozzle that sprays axially into the chamber is provided, wherein the compressed gas flowing through the stopper and the particle former, sucked in by the compressed gas stream from the supply bottle, will flow through the nozzle.

From European patent application 0 119 527 an extinguishing device for extinguishing fires is known. The extinguishing device has a chamber into which a water stream mixed with a foaming medium and an air stream can be guided, wherein the water-air-mixture is forced with foam formation through the sieve limiting the chamber.

SUMMARY OF THE INVENTION

The present invention has the object to make a device of the aforementioned kind suitable for further technical applications.

The device solving this object according to the invention is characterized in that a device for adjusting the amount of particle former transported by the spray jet per time unit and/or a device for adjusting the amount of compressed gas passing per time unit through the wall is provided.

Advantageously, such a device can be used, for example, for fluid treatment of sensitive, easily deformable objects, especially for their cooling, or other applications requiring certain metering of the particle formation, for example, in a burner. With the inventive use of a permeable wall having pores, it is possible to produce fluid particles with minimal kinetic energy by the effect of the compressed gas flowing through the permeable wall so that at the exit side of the wall a fluid particle stream with particles having extremely low energy per particle can be produced. With such a particle stream, for example, formed of liquid nitrogen, it is possible to cool and solidify liquid surfaces, without the solidified liquid surface showing deformations resulting from the effect of the stream.

Preferably, the particle former is sprayed onto the pressure-loaded walls such that simultaneously substantially the entire surface area of the permeable wall is wetted.

In one embodiment in which the fluid particles are used for treating deformation-sensitive objects, the permeability of the wall and the gas pressure are selected such that, for a continuous supply of the particle former, a continuous particle stream will exit from the wall with a kinetic energy per particle that is minimal in comparison to the kinetic energy of the spray jet particles. The amount of particle former transported by the spray jet per time unit can be adjusted via the pressure differential of the conveying pressure acting on the particle former and the gas pressure of the compressed gas. Furthermore, the permeable wall could be provided as an exchangeable part so that wall parts with different permeability can be used.

Advantageously, the permeable wall is substantially horizontally arranged and the aerosol former is applied from above onto the wall. In this case, the particle formation is enhanced by gravity. The wall, however, can be arranged in any desirable position and a particle former can also be forced through the wall especially vertically from below in the upward direction.

According to a preferred embodiment of the inventive device, the wall is a bottom wall of a pressure chamber receiving the spray jet and loaded by the compressed gas, wherein the pressure chamber is embodied especially cylindrically and the bottom wall and the spray jet are arranged coaxially to the cylinder axis.

A buffer volume can be arranged upstream of the pressure chamber for compensation of pressure fluctuations of the compressed gas.

Advantageously, the permeability of the permeable wall, the gas pressure, and the amount of particle former applied per time unit onto the wall are selected such that, for a continuous transport of the particle former from the surface of the permeable wall into the wall, the formation of a coherent liquid film of the particle former is prevented. In this manner it is ensured that at the surface of the permeable wall the impinging spray droplets of the particle former will break up into smaller particle units.

The permeable wall has through channels that are especially pore-like, preferably with through widths in the micrometer range (5 to 500 $\mu$m, depending on the pressure level).

Sinter discs, for example, especially made of metal, glass, or ceramic, can be used as permeable walls. It is furthermore possible that for producing a directed fluid particle stream a permeable wall is used which is provided with correspondingly oriented through channels.

Especially when using the device for cooling objects, the particle former can be liquid nitrogen and the compressed gas can be gaseous nitrogen.

The invention will be explained and described in more detail with the aid of a particular embodiment and the accompanying drawings relating to this embodiment. It is shown in:

DESCRIPTION OF PREFERRED EMBODIMENTS

Figure 1:
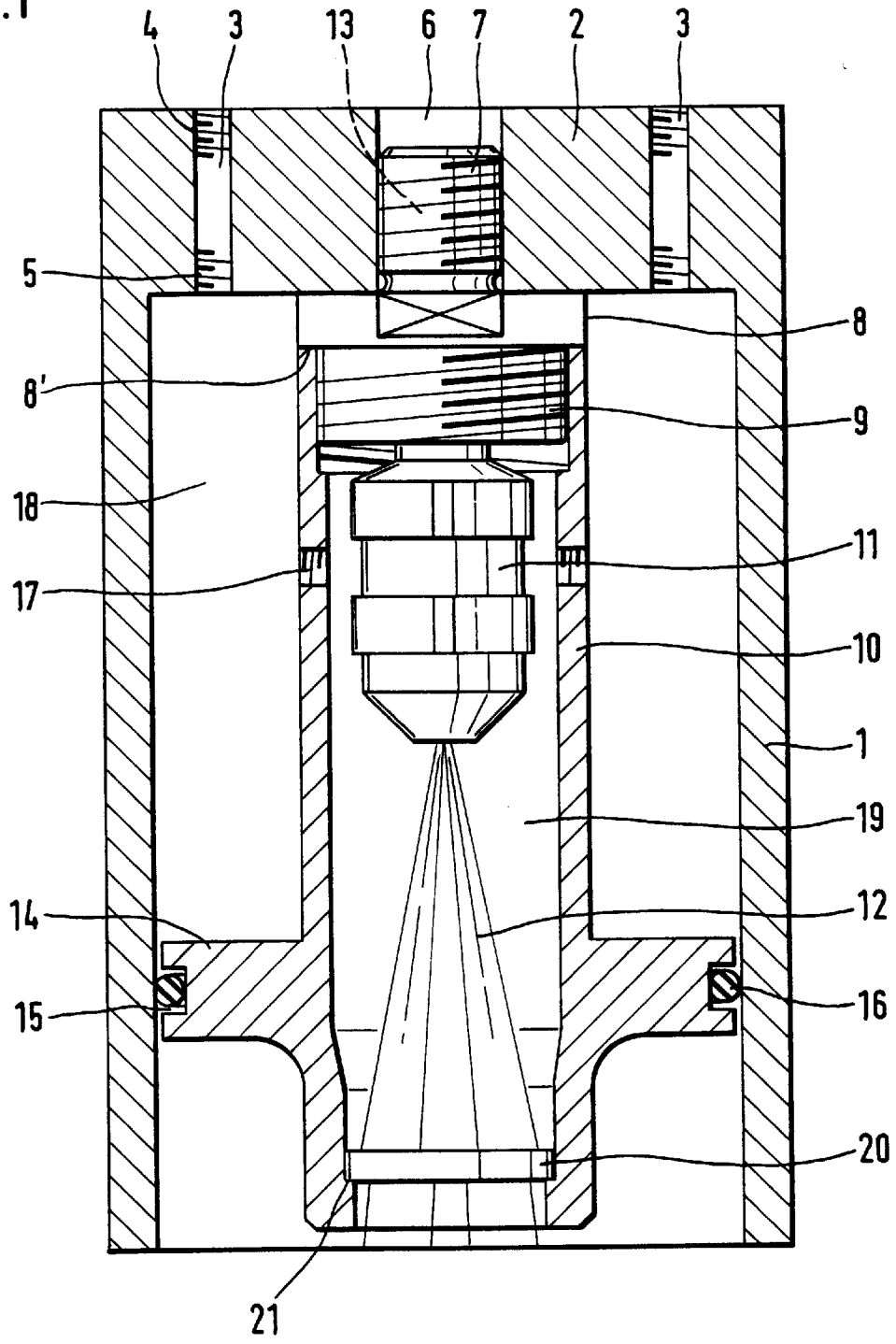
FIG. 1 an essential portion of an inventive device in vertical cross-section.

Reference numeral 1 indicates a cylindrical housing which is open in the downward direction and is closed by an end face 2 in the upward direction. In the end face 2 through bores 3 are provided having an upper inner thread 4 and a lower inner thread 5. The upper inner thread 4 serves as a connector of a compressed gas line connection with a compressed gas source (not shown in the Figures). A central bore 6 with an inner thread is also provided in the end face 2 into which an upper connecting piece 7 of the spray nozzle holder 8 with its matching outer thread can be threaded. The spray nozzle holder 8 has at its underside a further connecting piece 9 with an outer thread which can be threaded into a matching inner thread of a cylindrical insert 10 so that the spray nozzle holder 8 will come to rest with an annular shoulder 8' against an annular end face surface of the cylindrical insert 10. The projection 9 extending in the downward direction away from the spray nozzle holder 8 is connected to the spray nozzle 11 having impact surfaces (not illustrated in FIG. 1) for the atomization of a particle former to be sprayed therewith. The spray nozzle 11 generates a conically widening spray jet 12 of the particle former. In the present case the particle former is liquid nitrogen. The liquid nitrogen is supplied to the spray nozzle 11 via a through channel 13 passing through the spray nozzle holder 8 with the connecting pieces 7 and 9. The through channel 13 is connected by connecting means (not shown in the Figures) to a supply container for the liquid nitrogen.

Figure 2:
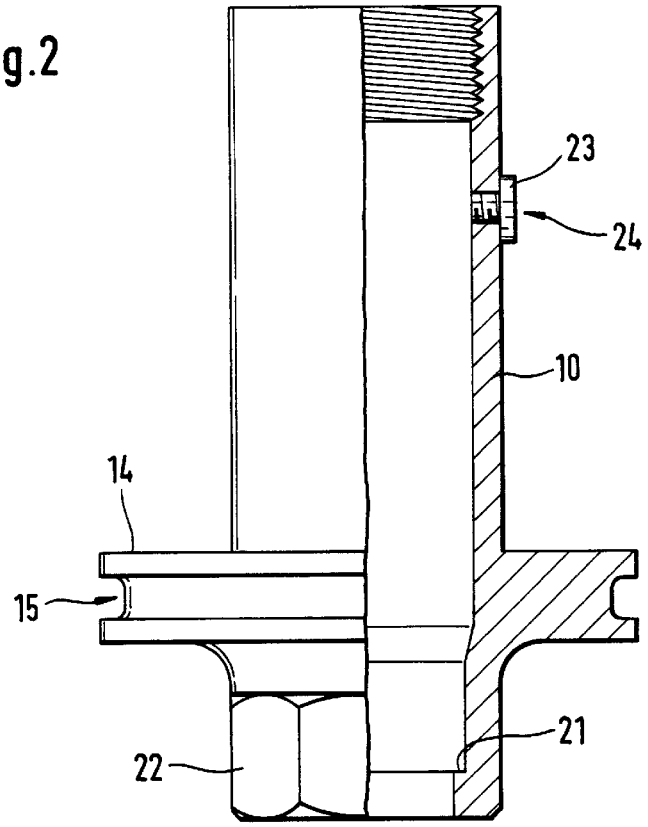
FIG. 2 a part, employed in the device of FIG. 1 for forming a pressure chamber, in a vertical part-sectional view.

As can be seen also in FIGS. 1 and 2, the cylindrical insert 10 has an annular projection 14 with an annular groove 15. An annular seal 16 made of a suitable sealing material such as, for example, rubber or NBR, is placed into the annular groove 15.

Reference numeral 17 indicates bores in the sidewall of the cylindrical insert 10 arranged at the level of the spray nozzle 11. They open outwardly into an annular buffer chamber 18 and inwardly into the pressure chamber 19 formed by the threadedly connected cylindrical insert 10.

Reference numeral 20 in FIG. 1 indicates a porous metal sinter disc which is pressed into the lower end of the tapering portion of the cylindrical insert 10 so that its circumference rests thereat and is supported on an annular shoulder 21 of the cylindrical insert 10. The sinter disc 20 made of stainless steel has in the shown embodiment a diameter of approximately 20 mm, a thickness of 2.5 mm, and a pore width of 70 $\mu$m.

As can be seen especially in FIG. 2, the cylindrical insert 10 is provided at its lower end with wrench attack surfaces 22 similar to those of a nut.

The part that is threadable into the bores 17 and has a central through bore 24 is identified by reference numeral 23. Such threadedly connected parts 23 are made available with a selection of different widths of the respective through bore 24. Such parts 23 are also threadable into the inner threads 5 in the end face 2.

For assembling the device shown in FIG. 1, first the component comprising the spray nozzle holder 8 with the pieces 7 and 9 as well as the spray nozzle 11 is threaded into the inner thread of the bore 6 in the end face 2 of the cylindrical housing 1. In the shown embodiment, the cylindrical housing 1 is surrounded by a non-represented double wall wherein between the shown wall and the non-represented second wall an intermediate space is formed as a thermal insulation of the housing 1. After threading of the aforementioned part with the spray nozzle into the bore 6, the part shown in FIG. 2 is inserted into the housing 1 and threaded onto the lower piece 9 of the spray nozzle holder 8 wherein the end of the cylindrical part 10 comes to rest against the annular shoulder 9 at the spray nozzle holder 8. The annular seal 6 closes off the buffer chamber 18 in a pressure-tight manner. Before the insertion of the cylindrical insert 10 into the housing 1, parts corresponding to the part 23 with through bores 24 of a desired width can be threaded into the bores 17 or/and the bores 5.

The aforementioned compressed gas source as well as the supply container for liquid nitrogen are provided with non-illustrated devices for pressure regulation so that the compressed gas can be supplied with the desired adjusted pressure via the other bores 3, the buffer chamber 18, and the bores 17 into the pressure chamber 19. Furthermore, the required pressure for spraying the liquid nitrogen through the spray nozzle 11 can be regulated. In order to enable the spray jet 12 to exit from the spray nozzle 11 within the pressure chamber 19, the conveying pressure of the liquid nitrogen must be slightly higher than the pressure of the employed compressed nitrogen gas. Because of this pressure differential, the amount of the sprayed material can be regulated while the absolute value of the pressures determines the throughput amount through the sinter disc 20. Pressure differential and absolute values of the pressure are to be adjusted such that no flow impediment with generation of a liquid film will occur on the sinter disc.

Liquid nitrogen sprayed onto the sinter disc 20 will impact onto the sinter disc 20 having pores so that the sprayed particles will break up on the surface and will be entrained by the pressurized gas continuously flowing through the sinter disc. In the shown embodiment, the permeability of the sinter disc 20, the inner pressure of the nitrogen gas within the pressure chamber 19, and the amount of liquid nitrogen sprayed per time unit onto the sinter disc 20 are metered such that no liquid film of liquid nitrogen can form on the disc, but that instead the liquid material will be transported at all times in a sufficient amount from the wall surface inwardly so as to prevent such liquid film formation. With a suitable conical widening of the spray jet 12 which covers the entire surface of the sinter disc 20, a uniform distribution of the liquid across the sinter disc 20 results.

By entraining the liquid particles in the compressed gas continuously flowing through the sinter disc 20, formation of small aerosol particles takes place in the narrow pores of the sinter disc 20 so that at the outer side of the sinter disc 20 opposite the pressure chamber an aerosol flow will exit. The aforementioned parameters are selected such that the kinetic energy per particle of this stream, in comparison to the energy of the spray particles in the spray jet 12, is very minimal. With this minimal particle energy the aerosol flow can be used for treating deformation-sensitive objects, for example, cooling them.

The present device can be used, for example, in the food industry in order to cool and solidify surfaces of pudding wherein the cooled and solidified surface does not exhibit any deformations caused by the cooling stream. Downstream of the sinter disc 20, a flowing mist with a high concentration of finest aerosol particles is formed by which an intensive cooling effect on the impacted surface can be produced.

In the disclosed device pressures of the compressed gas and throughput amounts of the particle former can be adjusted by respective devices. The sinter disc 20 can be removed from its press fit in the insert 10 and can be exchanged with another disc having a different permeability. The permeability can be regulated by the thickness of the disc as well as the width of the passages. With insert pieces 23 having different through bores 24 further variations of the compressed air flow are possible.

Figure 3:
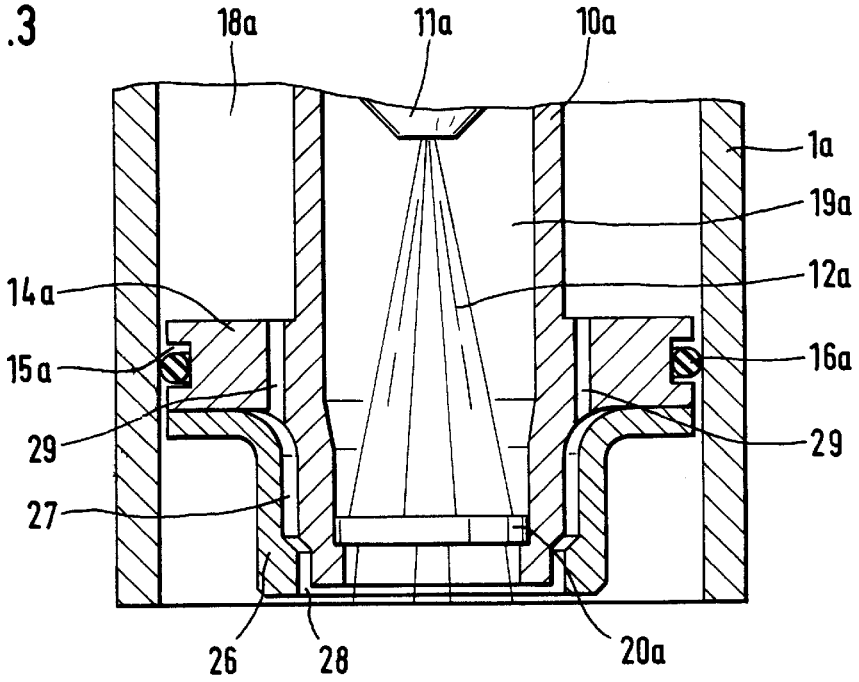
FIG. 3 an essential part of a device according to a second embodiment of the invention.

Reference is now being had to FIG. 3, where identical or identically acting parts have the same reference numerals as in the previous embodiment, but with the letter a added on.

Reference numeral 26 in FIG. 3 shows a guiding device arranged coaxially to the insert part 10*a* and connectable by non-represented threaded connections to a projecting annular part 14*a* of a cylindrical insert 10*a*. Between the guiding device 26 and the cylindrical insert 10*a* an annular chamber 27 with an annular outlet opening 28 is formed. The annular chamber 27 communicates via passages 29 with a buffer chamber 18*a* for compressed gas.

As can be seen in FIG. 3, the guiding device 26 projects slightly past the lower end of the cylindrical insert 10*a*.

Compressed air from the buffer volume 18*a* not only reaches via the connecting openings (not illustrated in FIG. 3) the pressure chamber 19*a*, but also via the passages 29 the annular chamber 27 and exits the annular opening 28 under formation of a hollow cylindrical flow. This hollow-cylindrical flow surrounds fluid particles exiting from a permeable wall 20*a* and produced of an aerosol former which is applied via a spray jet 12*a* of a spray nozzle 11*a* onto the permeable wall 20*a*.

With the annular flow exiting from the annular opening 28, the formation of ice, resulting from moisture within the air, at the end of the insert is prevented when, for example, employing liquid nitrogen as an aerosol former by which the cylinder insert 10*a* is greatly cooled. Such ice formation would be especially disadvantageous when using the device as a cooling device for foodstuffs because of the possibility of contamination of the foodstuffs by ice and the resulting bacteriological loading. The protective gas flow thus prevents air from reaching the end of the cylindrical insert 10*a*. The relatively warm protective gas ensures that at the lower end of the guiding device 26 no ice will occur instead.

The disclosed device could also be used for producing a burner flame wherein under formation of a very reactive mixture a compressed gas that is combustible with the aerosol can be used, and wherein the outer film provides a cooling function for the nozzle and a protective and support function for the flame. For this purpose, a cooling and insert gas independent of the compressed gas could be used, for example, compressed air, argon, or/and $CO_2$ as well as $O_2$.

For formation of large surface area flames, it is possible to provide large surface area permeable walls wherein desired patterns of flame carpets can be produced with a plurality of spray nozzles arranged upstream of the walls, that can be selectively used for application of the aerosol former onto the permeable wall.

It is furthermore possible to provide permeable walls with layers of different permeability. It is also possible in this context to employ permeable walls arranged at a spacing to one another so as to form intermediate spaces therebetween.

The surface of the permeable wall could, for example, be curved for compensation of the spray particle density of the spray jet that changes in cross-section. For formation of a certain aerosol stream, it is also possible to suitably shape the exit surface for the fluid particles.

In addition to the above mentioned use of the compressed gas as a reaction gas, for example, in a burner, the compressed gas can also provide the opposite function of an inert gas flow.

The pressure chamber 19 with the sinter disc 20 forms a second stage of the material distribution as well as a damping stage. As a first stage all known nozzles can be used: liquid nozzles, air atomization nozzles, ultrasound nozzles, multi substance nozzles. The more gas phase is guided through the first stage into the pressure chamber, the less compressed gas is additionally needed.

The above disclosed device with a pressure chamber 19, comprising a permeable wall 20 and especially inlets comprising a nozzle 11 for media under pressure, can also be used in order to mix different media homogeneously, e.g., gases with gases, liquids with liquids, and gases with liquids.

During mixing, the pressure chamber can, for example, be subjected to a liquid flow wherein the porous wall provides a throttle. With overpressure, a gas phase, a mixed phase, or a further liquid is then injected into the pressure chamber. With the increased pressure in the pressure chamber, the media will mix. After passing through the porous wall, they are then in a mixed state under reduced pressure.

What is claimed is:

1. A device for producing an aerosol from an aerosol former, the device comprising a permeable wall (20) having through channels configured to form fluid particles of the aerosol, a nozzle (11) for applying the aerosol former in the form of a spray jet (12) onto the permeable wall (20), and a device for loading the permeable wall (20) with a compressed gas penetrating the permeable wall while entraining the aerosol former under formation of the aerosol, and further comprising at least one of a device for adjusting the amount of the aerosol former transported by the spray jet (12) per time unit and a device (24) for adjusting the amount of compressed gas flowing through the wall per time unit.

2. The device according to claim 1, wherein the permeability of the wall (20), the gas pressure, and the amount of aerosol former (12) applied per time unit onto the wall are selected such that for a continuous transport of aerosol former away from the wall surface the formation of a coherent liquid film of the aerosol former is prevented.

3. The device according to claim 1, wherein the spray nozzle (11) is configured to produce a conically widening spray jet (12) which substantially wets the entire surface of the wall (20).

4. The device according to claim 1, wherein the device comprises a pressure chamber (19) and wherein the wall is a bottom wall (20) of the pressure chamber (19), wherein the pressure chamber (19) receives the spray jet (12) and is loaded with the compressed gas.

5. The device according to claim 4, wherein the pressure chamber (19) is cylindrical and the bottom wall (20) and the spray jet (12) are coaxially arranged relative to the cylinder axis.

6. The device according to claim 5, wherein a buffer volume (18) for the pressure gas is arranged upstream of the pressure chamber (19).

7. The device according to claim 1, wherein the through channels have through widths within the micrometer range.

8. The device according to claim 1, wherein the permeable wall is comprised of at least one sinter material selected from the group consisting of ceramic, glass, and metal sinter material.

9. The device according to claim 1, wherein the permeable wall is configured as a flame backdraft protection.

10. The device according to claim 1, wherein the through channels are configured to generate a directed aerosol stream.

11. The device according to claim 1, wherein at least one of the aerosol former and the compressed gas comprises liquid nitrogen or gaseous nitrogen.

12. The device according to claim 1, further comprising a holder for an object to be treated by the aerosol.

13. The device according to claim 1, wherein the device comprises a hollow cylinder (10) forming a pressure chamber (19), wherein the permeable wall (20) is provided at one end face of the hollow cylinder (10), wherein the hollow cylinder (10) at the end opposite the permeable wall (20) has a thread configured to be threaded onto a support member (8) for the nozzle (11).

14. The device according to claim 13, wherein the device comprises a cylindrical housing (1) and wherein the support member (8) projects from a bottom part (2) of the cylindrical housing (1), wherein the hollow cylinder (10) has an annular projection (14) that, when the hollow cylinder (10) is threadingly connected to the support member (8) for the nozzle (11), sealingly rests against the inner wall of the cylindrical housing (1) so that a buffer chamber (18) is formed between the cylindrical housing (1) and the hollow cylinder (10).

15. The device according to claim 14, comprising a device configured to generate an inert gas flow enveloping the aerosol particles exiting from the permeable wall **(20*a*)**.

16. The device according to claim 15, wherein the device for producing the inert gas flow comprises a guiding device (26) surrounding the hollow cylinder **(10*a*) for the formation of an annular chamber (27) that surrounds the hollow cylinder (10*a*) and has an annular opening (28) for the inert gas flow, and wherein the annular projection (14) of the hollow cylinder (10*a*) comprises passages for connecting the buffer volume (18*a*) with the annular chamber (27)**.

* * * * *